United States Patent [19]
Nardi
[11] 4,283,780
[45] Aug. 11, 1981

[54] RESONANT ACOUSTIC TRANSDUCER SYSTEM FOR A WELL DRILLING STRING

[75] Inventor: Anthony P. Nardi, Burlington, Mass.

[73] Assignee: Sperry Corporation, New York, N.Y.

[21] Appl. No.: 114,038

[22] Filed: Jan. 21, 1980

[51] Int. Cl.³ ..... G01V 1/40
[52] U.S. Cl. ..... 367/82; 367/180; 367/165; 310/322; 310/334; 310/355
[58] Field of Search ..... 367/82, 155, 165, 180; 310/322, 323, 334, 355

[56] References Cited

U.S. PATENT DOCUMENTS

| | | | |
|---|---|---|---|
| 2,858,108 | 10/1958 | Wise et al. | 367/82 |
| 3,900,827 | 8/1975 | Lamel | 367/82 |

*Primary Examiner*—Howard A. Birmiel
*Attorney, Agent, or Firm*—Howard P. Terry

[57] ABSTRACT

For use in transmitting acoustic waves propated along a well drilling string, a piezoelectric transducer is provided operating in the relatively low loss acoustic propagation range of the well drilling string. The efficiently coupled transmitting transducer incorporates a mass-spring-piezoelectric transmitter combination permitting a resonant operation in the desired low frequency range.

7 Claims, 7 Drawing Figures

FIG.1.
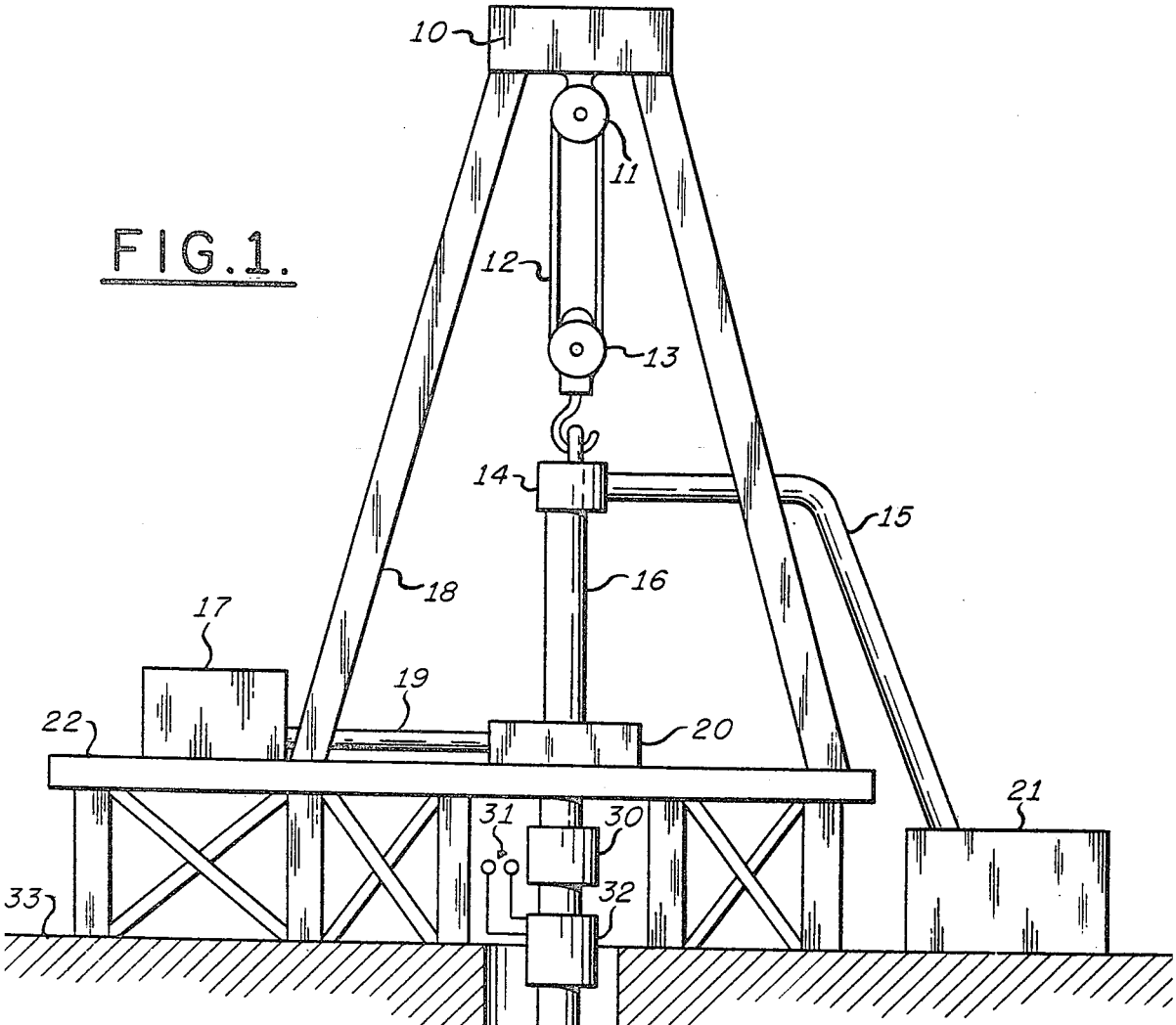
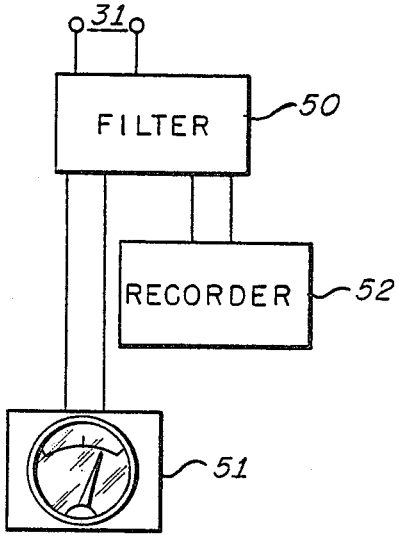
FIG.1A.

RESONANT ACOUSTIC TRANSDUCER SYSTEM FOR A WELL DRILLING STRING

The invention herein described was made in the course of or under a contract or subcontract with the United States Energy Research and Development Agency.

CROSS REFERENCE TO RELATED APPLICATION

The present application is related to the co-pending U.S. patent application Ser. No. 114,039, filed concurrently herewith on Jan. 21, 1980, in the names of P. G. Mitchell and W. H. Kent, entitled "Acoustic Transducer System for A Well Drilling String", and assigned to Sperry Corporation.

BACKGROUND OF THE INVENTION

1. Field of the Invention

The invention relates generally to the art of transmitting information in the form of acoustic waves propagating along a well drilling string or other similar pipe. More particularly, the invention concerns novel piezoelectric transducer apparatus modified for improved operation in the relatively low loss acoustic frequency propagation range of the well drilling string or similar piping.

2. Description of the Prior Art

There are many illustrations in the prior art of data transmission systems for telemetering data in either direction along well drilling strings, some employing electrical and others acoustic propagation. The acoustic systems generally operate in relatively high frequency ranges spaced apart from the large volume of low frequency energy developed by the operating elements of the drilling process. Most of the drilling noise is concentrated in the relatively low frequency range which is desirable for acoustic telemetering because of its relatively low propagation loss characteristics. It is the intent of the present invention to supply transducer means for efficiently coupling acoustic energy into the drill string at relatively high levels competitive with the level of the drilling noise.

SUMMARY OF THE INVENTION

The present invention provides an acoustic communication system including an acoustic transmitter and receiver, wherein lower frequency acoustic waves, propagating in relatively loss free manner in well drilling string piping, are efficiently coupled to the drill string and propagate at levels competitive with the levels of drilling machinery generated noise energy also present in the drill string. The transmitting transducer permits resonant operation in the desired lower frequency range. The combination features a spring in the general shape of a bellows having spaced corrugations to provide a suitable spring constant in the longitudinal direction. The spring provides an enclosure within which is mounted a cooperating mass.

BRIEF DESCRIPTION OF THE DRAWINGS

FIG. 1 illustrates, in partial cross-section, an elevation view of drilling apparatus employing an acoustic transmitter according to the present invention.

FIG. 1A is a diagram of surface and other equipment useful with the apparatus of FIG. 1.

DESCRIPTION OF THE PREFERRED EMBODIMENTS

Figure 2:
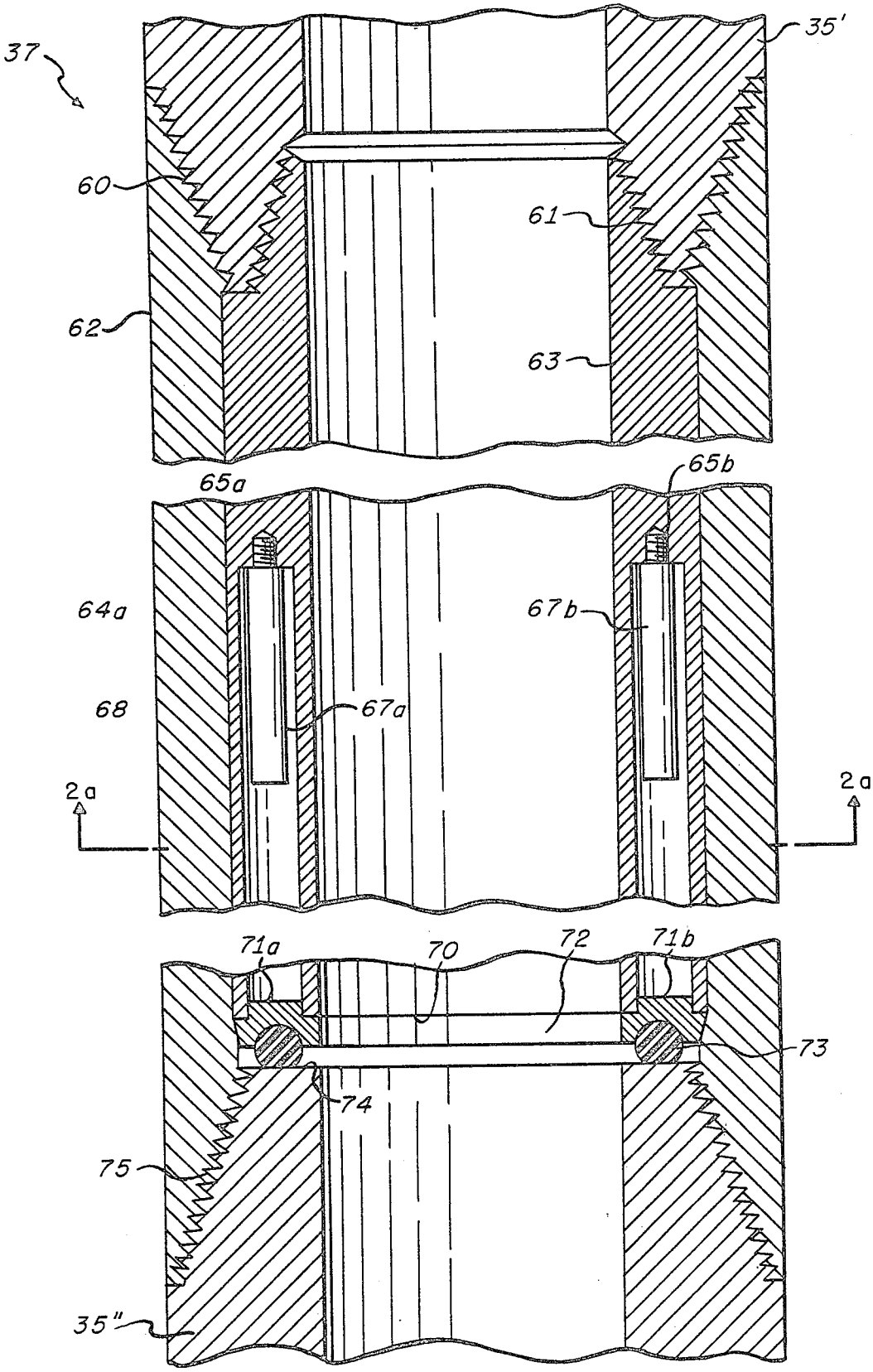
FIG. 2 is an elevation view in cross section of a down-well portion of the apparatus of FIG. 1.

FIG. 1 illustrates the principal elements of the novel telemeter or communication system and of the well drilling apparatus employed for drilling a well bore 36 below the surface 33 of the earth. Use is made of the drill string 35 and the drill bit 40 for drilling the bore 36 and the drill string 35 is also adapted simultaneously to be used as an acoustic propagation medium for telemetering data relative to the progress or state of the drilling operation upward to instruments located above the earth's surface 33, for example.

The drilling apparatus of FIG. 1 includes a derrick 18 from which is supported the drill string 35 terminated by the drill bit 40. Drill string 35 is suspended by a movable block 13 from a top platform 10 of derrick 18 and its vertical position may be changed by operation of the usual cable loop 12 by winch 11 suspended from platform 10. The entire drill string 35 may be continuously rotated by the rotation of rotary table 20 and the polygonal kelly 16 slidably passing through a correspondingly shaped aperture in rotary table 20. Motor 17, located on the surface or drilling platform 22 near rotary table 20, and shaft 19 are used to drive table 20 and therefore to rotate drill string 35. This conventional apparatus may be completed in essential detail by a swivel injector head 14 at the top of kelly 16 for receiving drilling mud forced through pipe 15 by a pump located in the mud pump apparatus 21. The drilling mud is forced down into the well through the hollow pipe of the drill string 35 into the working region of bit 40 for cooling purposes and for removing debris cut out by bit 40 from the well bore. The used mud and its included debris are returned upward to the earth's surface in bore 36, where conventional apparatus (not shown) separates the mud, rejuvenating it for further cycles of use.

The portion of the drill string 35 below the earth's surface 33 will generally contain many major sections of threaded-together pipe elements. Near the earth's surface and at the lower part of the drill string 35, there will appear sub-units or pipe-like segments of minor length similarly joined in the drill string and sometimes larger in diameter than the major and much longer elements of the drill string. As has been well established in the art, these sub-units are provided as protective containers for sensors and their ancillary circuits, and for power supplies, such as batteries or conventional mud driven turbines which drive electrical generators or other means to supply electrical energy to operate sensor devices or the like.

As noted, the drill string 35 is to serve as an acoustic energy propagation path whereby data may be telemetered between bit 40 and surface monitoring apparatus. It is seen that drill string 35 has three sub-units adjacent bit 40, by way of example. In ascending order above drill bit 40, the first of these is the acoustic isolator sub-unit 39 including a mechanical filter for isolating the communication system from the energetic and wide band noise generated by drill bit 40 during its actual operation. Such mechanical filters are well known in the prior art, as typified by apparatus disclosed in the U.S. patent to H. B. Matthews U.S. Pat. No. 4,066,995 for "Acoustic Isolation for a Telemetry System on A Drill String", issued Jan. 3, 1978 and assigned to Sperry Corporation.

In the next above sub-unit 38 is installed in a conventional manner a sensor or sensors adapted to generate an electrical measure or measures of data relating to the operation of drill bit 40, such as fluid pressure or temperature or the like. The sensor output signals are used to modulate an acoustic transmitter located in the third of the series sub-units 37, for example. It is recognized that pluralities of sensors may be served in this manner by employing multiplexing apparatus such as in the U.S. Pat. No. 3,988,896 to H. B. Matthews entitled "Geothermal Energy Pump and Monitor System", issued Nov. 2, 1976 and also assigned to Sperry Corporation. The vibrations of the acoustic transmitter within sub-unit 37 are coupled to drill string 35, thereby exciting a data encoded acoustic wave which propagates toward the earth's surface 33 along drill string 35.

Near the top of drill string 35 is located a conventional receiver sub-unit 32 for containment of a device for receiving the acoustic wave propagating within drill string 35. The receiver within sub-unit 32 may be made directional and is adapted to furnish the telemetric data via terminals 31 through the band pass electrical filter 50 of FIG. 1A to a display such as a conventional electrical meter 51 or to a suitable recorder 52. It will be appreciated by those skilled in the art that a synchronously multiplexed receiver and recorder system such as illustrated in the aforementioned U.S. Pat. No. 3,988,896 may be alternatively employed.

Between receiver sub-unit 32 and the rotary table 20, there is disposed in drill string 35 a second noise isolation sub-unit 30 which may contain a mechanical filter generally similar to that of sub-unit 39. Its function is to attenuate vibrations within the pass band of the receiver due to the gear driven rotation of rotary turn table 17 and to the operation of various other apparatus on the drilling platform 22 including kelly 16. Acoustic noise within the pass band of the receiver that may arrive at the receiver input as a result of pulsations in the flowing mud generated by the mud pump of apparatus 21 may also be attenuated by placing a suitable damper (not shown) in pipe 15.

Figure 2A:
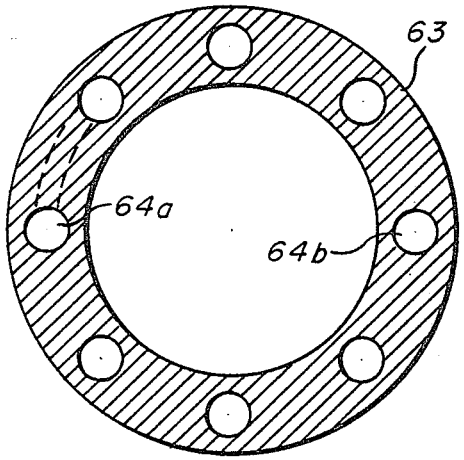
FIG. 2A is a cross section view taken at the line 2A—2A of FIG. 2.

FIGS. 2 and 2A illustrate in more detail the actual locations of the acoustic transmitter invention within walls of the acoustic transmitter sub-unit 37. The sub-unit housing 37 consists of two cooperating coaxial hollow cylinders 62, 63. The inner cylinder 63 is attached by threads 61 to the lower end of a unit 35' of the drill string 35 of FIG. 1 and ends at surface 70 at right angles to the axis of the drill string. The second hollow cylinder 62 has an inner wall 68 which is normally in contiguous relation with the outer surface of the wall of cylinder 63. Furthermore, outer cylinder 62 is attached by threads 60 to the upper drill string part 35'.

As is seen in FIGS. 2 and 2A, the hollow cylinder 63 is equipped with a plurality of bores, such as the opposed bores as cylindrical cavities 64*a*, 64*b*. By way of example, the two opposed bores or cavities 64*a*, 64*b* may be employed for containment of active co-phasally driven acoustic transducers, while other of the bores shown in FIG. 2A may be used as locations for other down-well equipment or for conventional vibration-driven power supplies or batteries for activating those various electronic elements, including apparatus associated with the acoustic transducers.

Referring to FIG. 2, according to the invention, each of the opposed cavities 64*a*, 64*b* contains an acoustic transmitter transducer 67*a* or 67*b*. For example, the transmitter device within bore 64*a* includes a piezoelectric driver and resonating mass system 67*a*, both supported in colineal relation by a threaded bolt 65*a* extending into a threaded bore at the upper internal end of bore 64*a*. An accelerometer device 66*a* may be affixed at the free end of the transmitter device.

To keep components of the drilling mud, flowing in the interior of hollow cylinder 63, from entering the bores such as bore 64*a*, a ring-shaped end piece 72 is provided fitting against the end 70 of cylinder 63. Ring 72 is equipped with spaced circular bosses such as bosses 71*a*, 71*b* which extend into the bores or cavities 64*a*, 64*b*, et cetera, excluding such contaminants. Ring 72 may be permanently or semi-permanently affixed to surface 70, as desired. Other such closure means may readily be envisioned.

The outer hollow cylinder 62 is equipped with threads 75 at its lower end disposed below the aforementioned parts. Its purpose is to enable coupling of the sub-unit 37 to the next lowest portion 35'' of the drill string 35. In addition, the drill string part 35'' is equipped with a flat upper surface 74 perpendicular to its axis. In this manner, when sub-unit 37 is affixed to drill string portion 35'', an O-ring 73 or equivalent device is compressed by surface 74 into an annular O-ring seat disposed in the lower annular face of ring 72. It is seen that the assembly permits successful successive coupling and uncoupling of sub-unit 37 between drill string portions 35', 35'', the inner cylinder 63 containing and protecting the acoustic transmitter system and the outer cylinder 62 cooperating in the same function and also serving as the primary load-bearing connection between drill string portions 35', 35''. It will be understood by those skilled in the art that the FIG. 2 transducer 67*a* and its container 63 may be inverted so that bore 64*a* is pointed upward and so that the transducer 67*a* projects upward from a corresponding bolt 65*a*. It will further be understood that the dimensions and proportions in the various figures have been distorted in the interest of making the drawings clear and that the dimensions illustrated would not necessarily be used in practice. In one practical embodiment of the invention, by way of example, the transducer element was about one inch in diameter, its over-all length about 1.5 feet, and the mass-spring resonator was about two feet long.

Figure 3:
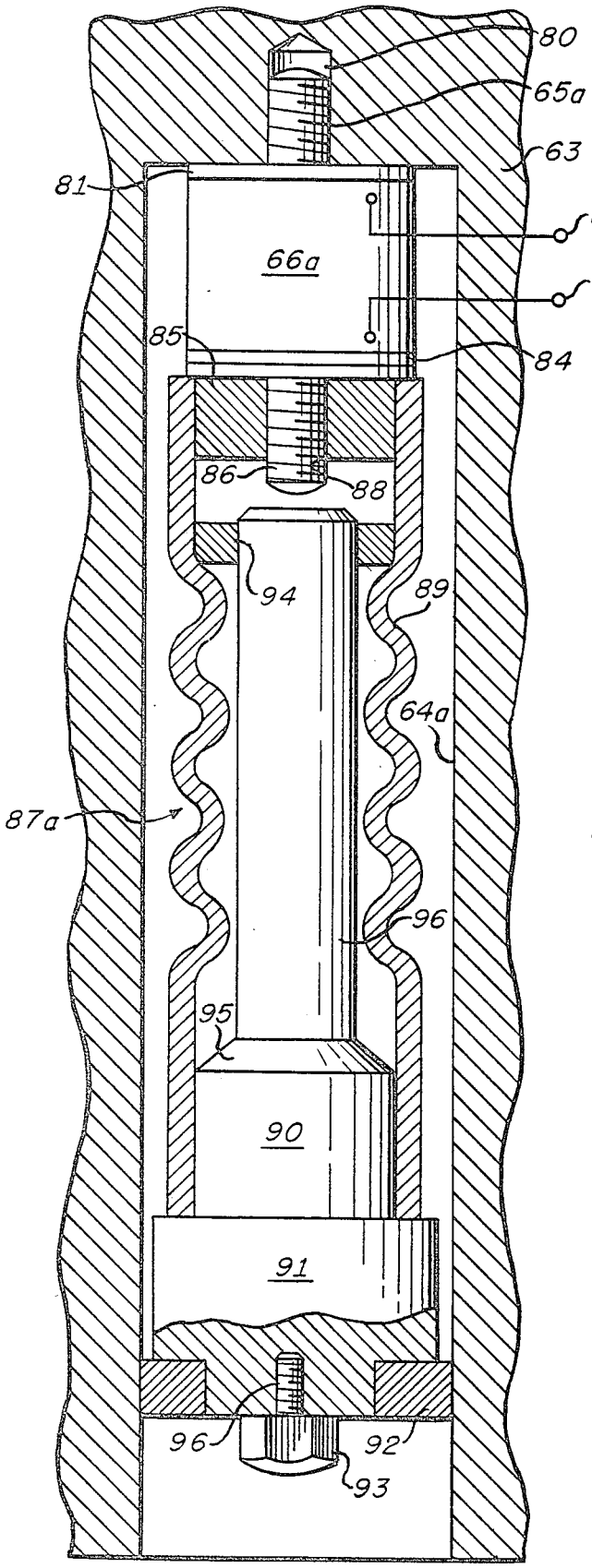
FIG. 3 is an enlarged view, partly in cross section, of the transducer element found in FIG. 2.

The sonic transmitter assemblies 67*a*, 67*b* of FIG. 2 each take the form shown in more detail in FIG. 3; as shown in FIGS. 2 and 3, each such transducer assembly is suspended by a headless bolt 65*a* threaded into a bore 80 within the top surface of a wall of hollow cylinder 63. Bolt 65*a* extends through a generally conventional sonic piezoelectric wave exciter 66*a* including, as will be further discussed, an assemblage of piezoelectric disks. The piezoelectric disks of element 66*a* are maintained in axial compression between apertured insulator end disks 81, 84. This is accomplished by the hollow cylindrical portion 85 of a cooperating steel member having an axial bore 88, bore 88 being threaded in the vicinity of the lower end of bolt 86. In practice, the hollow internally threaded part 85 is rotated on the threads of bolt 86 until the stack of ceramic high dielectric disks within piezoelectric element 66*a* experiences the desired level of compression. The threaded steel part 85 may then be fixed against further rotation with respect to the threads of bolt 86 in the usual manner. If desired, the upper end 65*a* of the headless bolt 86 may be pinned in the same manner, but with respect to wall 63. Bolt 86 is made of an age-hardened, high strength, low thermal expansion alloy such as a corrosion resistant alloy of nickel, iron, and chromium sold as type 903 under the trademark Incoloy by the International Nickel Company. In any event, when bolt 86 is once properly stressed by rotation of the threaded steel part 85, compression of the piezoelectric stack 66*a* remains substantially constant.

The threaded steel part 85 forms a suspension for a novel spring-mass system to be vibrated axially by piezoelectric driver 66*a*. In particular, a hollow tube has an end section 87 whose inner diameter matches the outer diameter of part 85 and is welded or otherwise permanently affixed thereto. At a mid-section of the tube is a bellows-like corrugated section 89 which forms an active axial spring for the system. The spring bellows 89 and its opposed constant diameter ends 87, 98 are preferably formed of a stainless steel tubing with its mid-section 89 swaged into a regular multiply corrugated shape for providing the required longitudnal spring action along the spring axis. Characteristic of the spring section 89 is the fact that it desirably retains substantially the same lateral rigidity as is present in the original tube itself, and for the same reasons.

At the free end 98 of spring 87, 89, 98, the inner diameter of the tube section matches the outer diameter of a section 90 of the suspended mass 90, 91, 96 and is fastened permanently thereto, as by welding. A tapered portion 95 integral with section 90 extends above it and integrally supports a mass element 96 whose diameter is designed to clear the inner surface of the bellows spring 89. The free end portion 91 of mass 90, 91, 96 has an expanded diameter relative to portions 90, 96, but slidably clearing the inner surface of the bore 64*a* in wall 63. Affixed in a ring-shaped depression in the mass part 91 is an annular bearing 92 constructed of hardened steel, lubricated upon assembly. The bearing surface provided moves axially in relatively friction-free manner in contact with the steel surface of circular bore 64*a*. Another annular bearing 94 is permanently affixed to the inner wall of the unconvoluted portion 87 of the bellows 89 so that the free end of mass 96 may slide easily therewithin and so that mass 96 may not contact bellows 89. Bearings 92 and 94 are preferably of hardened steel.

The end portion 91 of the mass system is conveniently fitted with an integral hexagonal bolt head 93 to facilitate inserting and withdrawing the assembly from threaded bore 80. The integrated mass 90, 91, 96 may be constructed of steel, though other materials may be found suitable. Sintered or solid tungsten, because of its high density, is of special interest. Certain known tungsten-copper alloys are also candidate materials. An additional advantage of the novel configuration shown in FIG. 3 lies in the re-entrant disposal of the mass elements 90, 91, 95, 96 into the interior of the bellows spring portion 89, making full use of available space and making it possible for the length of the transmitter and of the bores 64*a*, 64*b*, et cetera, to be shortened, thus decreasing the overall length of the sub-unit 37 and its cost.

Figure 3A:
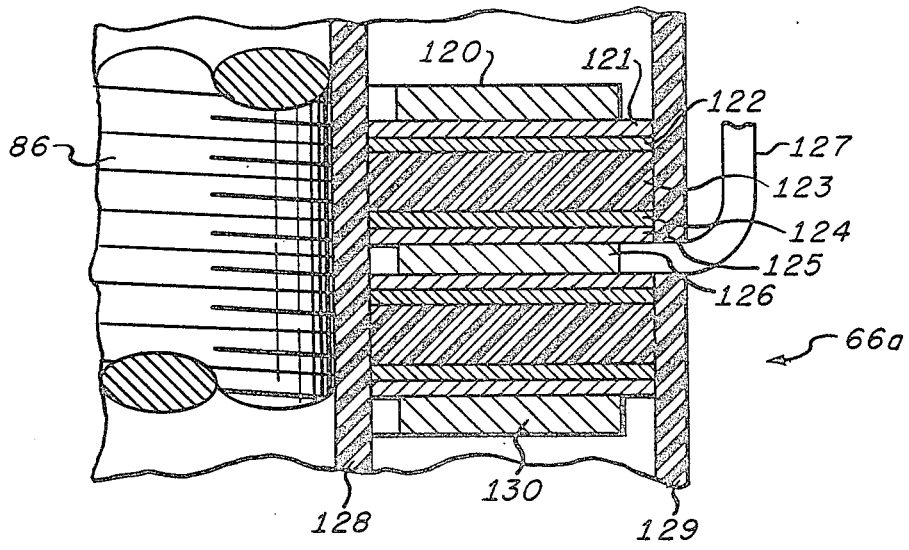
FIG. 3A is a fragmentary cross section view of a part of the piezoelectric driver of FIG. 3.

As shown in FIG. 3A, a generally conventional piezoelectric driver system may be employed as the sonic driver of the kind known to produce axial vibrations when an alternating voltage is coupled to leads 82, 83 of FIG. 3. In general, the disks making up the driver 66*a* are prepared and assembled following prior art practice such as widely discussed in the literature. In one design of the driver 66*a*, a stack of about 200 ceramic apertured disks such as disk 123 was employed, each disk with a $\frac{7}{8}$ inch outside diameter and with a centered $\frac{3}{8}$ inch hole. The disks were formed of PZT 5550 material readily available on the market. The opposed faces of each disk were optically lapped and supplied with a sputtered chromium layer such as layers 122, 124 adhesive to the ceramic surface and then an electrically conductive gold layer such as layers 121, 125 readily adhesive to the chromium. When the disks were stacked, thin conductive plates, such as the apertured plates 120, 126 were interposed. Alternate ones of these plates, such as plate 126, were coupled to one terminal of the a.c. driving power source each by a tab 127, while the intervening plates, such as plates 120, 130, were similarly coupled to the second terminal of that driving power source. In this manner, the total stack 66*a* of the ceramic element is electrically in parallel when driven, but yields serial or axial cyclic longitudinal expansion and contraction. A conventional insulating or protective tape may be wrapped about bolt 86, as at 128, and around the driver stack, as at 129.

Figure 4:
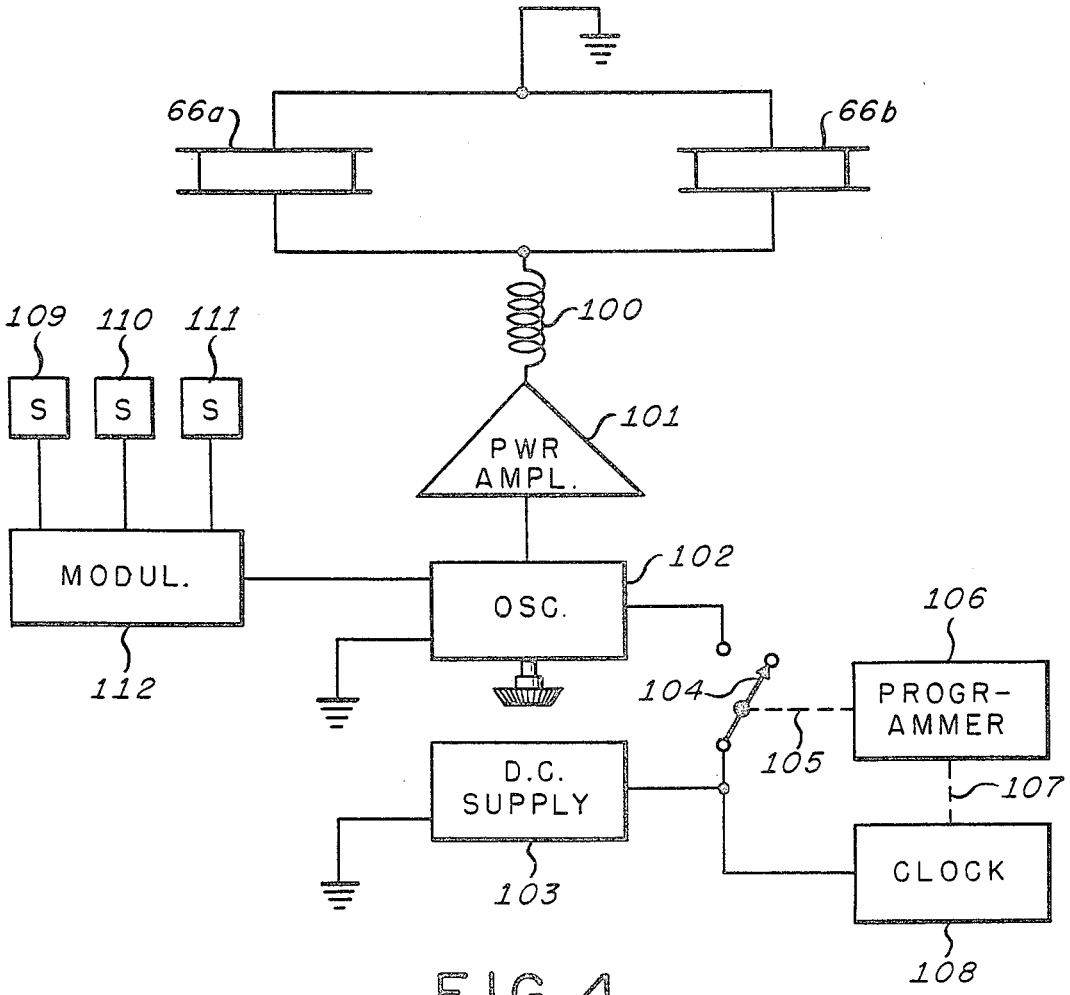
FIG. 4 is an electrical diagram of apparatus for operating the piezoelectric driver of FIG. 3 showing electrical components and their interconnections.

In FIG. 4, a power supply and control suitable for driving two of the transducer drivers 66*a*, 66*b* of FIG. 2 is shown, the two drivers being connected in parallel and then in series through an electrically resonating inductance 100 to the output of power amplifier 101. Amplifier 101 may be driven by a conventional tunable oscillator 102 operating in the general region of 400 Hz., for example.

Oscillator 102 may be put into action by a time programmed switch 104 which may be controlled through mechanical link 105 by a conventional programmer 106 operated by clock 108 via mechanical link 107. In this manner, economical use may be made of d.c. supply or battery 103, since the transducer system needs to be operated periodically for only a fraction of a minute in order to convey sufficient data to earth's surface. Furthermore, the arrangement makes it easy to start clock 108 as the sub-unit 37 is inserted at the earth's surface into drill string 35 to be lowered into the well.

It will also be understood that data sensed by a sensor such as pressure pick-off 109 may be coded by well known means and supplied as an intelligence bearing modulation by modulator 112 to the carrier frequency generated by oscillator 102 in the general manner taught, for instance, in the aforementioned Matthews U.S. Pat. No. 3,988,896. Additional pick-offs or sensors 110, 111, et cetera, may be used in a similar manner to convey data to the earth's surface for display or recording purposes employing the Matthews concepts for synchronous multiplexing and demultiplexing of the data. Sensors 109, 110, 111 may provide information on pressure, temperature, or the like in this manner.

It will be seen that, for greatest energy transfer between amplifier 101 and the drill string 35, the transducer should be adjusted to be mechanically and electrically resonant at the same frequency. The piezoelectric driver transducer 66*a* is electrically capacitive (C) so that inductor 100 (L) is made adjustable to the appropriate value, giving a resonance frequency $F_1$:

$$F_1 = \frac{1}{2\pi}\sqrt{\frac{1}{LC}}$$

Where two transducers are in parallel, the value C will, of course, be the effective capacitance of the parallel connected transducers. The series inductance 100 has the effect of amplifying the voltage across transducer element or elements 66*a*, 66*b* in proportion to the quality factor Q of the circuit. The electrical resonance is complemented by the mechanical resonance across each piezoelectric stack 66*a*, 66*b*. The mechanical loading of the piezoelectric stack with the stiff spring 89 and the extended mass 67*a*, for example, makes use of the stack compliance and the spring compliance to aid in controlling the free vibration of the mass. The mechanical resonance frequency $F_2$ for a mass 67*a* of M kilograms and a proportionality constant K in Newtons per meter is readily calculated as:

$$F_2 = \frac{1}{2}\sqrt{\frac{K}{M + \frac{m}{3}}}$$

Since spring 89 contributes about one third of its mass m to the inertia of the moving system, this contribution must be accounted for in the equation for $F_2$.

It is seen that the mass-spring combination permits resonant operation of the piezoelectric transducer and is a novel and useful means for extending the mechanical resonance of the piezoelectric system to lower frequencies than is conventionally possible. The selected resonant frequency may be lower than previously, in the frequency range within which acoustic transmission losses in the drill string are favorably lowest. Those skilled in the art will appreciate that the novel transducer will serve as an acoustic receiving transducer equally as well as a transmitter of acoustic waves.

While the invention has been described in its preferred embodiments, it is to be understood that the words which have been used are words of description rather than of limitation and that changes may be made within the purview of the appended claims without departing from the true scope and spirit of the invention in its broader aspects.

What is claimed is:

1. In a system for the acoustic propagation of data along a bore-hole drilling string, primarily during drilling operation thereof, an acoustic transducer physically coupled to said bore-hole drilling string and comprising:

a piezoelectric transmitter having a first axis and adapted for compression and elongation along said first axis when excited by a variable electric field disposed thereacross, a first fastener extending through said piezoelectric transducer means along said first axis, a second fastener for affixing said piezoelectric transmitter means against a surface of said bore-hole drilling string and for holding said piezoelectric transmitter in cooperation with said first fastener in substantially fixed compression, a corrugated tubular bellows-like spring affixed to and extending from said second fastener opposite said piezoelectric transmitter and having an axis colineal with said first axis, and an elongate cylindrical mass having a cylindrical axis colinear with said first axis and extending from and coupled integrally with said corrugated tubular bellows-like spring into the interior thereof opposite said second fastener, said first axis extending substantially parallel to the axis of said bore-hole drilling string.

2. Apparatus as described in claim 1 wherein said piezoelectric transmitter and said corrugated tubular bellows-like spring are characterized by supporting mechanical resonance with respect to said elongate cylindrical mass at a predetermined frequency.

3. Apparatus as described in claim 2 further including an electrical signal generator, and an inductance coupled in series relation between said electric signal generator and said piezoelectric transmitter, said inductance and said piezoelectric transmitter being adapted to operate in electrical resonance at said predetermined frequency.

4. Apparatus as described in claim 3 wherein said electrical signal generator comprises:

a carrier generator, a sensor for providing an output characteristic of a measure of a phenomenon existing in the vicinity of said bore-hole drilling string, and a circuit for modulating said carrier as a function of said sensor output.

5. Apparatus as described in claim 1 wherein:

said bore-hole drilling string comprises a hollow pipe having a cylindrical wall of finite thickness, said cylindrical wall includes at least one cylindrical cavity disposed entirely within said cylindrical wall, thereby providing said surface of said bore-hole drilling string cooperating with said second fastener.

6. Apparatus as described in claim 5 wherein:

said cylindrical cavity additionally includes a cylindrical wall, and said elongate cylindrical mass is provided with a first substantially friction-free bearing at its end remote from said second fastener bearing against said cylindrical wall for ensuring that the axis of said cylindrical cavity and of said elongate cylindrical mass are substantially colineal, said elongate cylindrical mass being enveloped in major part within said corrugated tubular bellows-like spring.

7. Apparatus as described in claim 6 wherein said cylindrical mass is additionally provided with a second substantially friction free bearing at its end adjacent said second fastener bearing against the inner surface of a non-convoluted portion of said bellows-like spring adjacent said second fastener means.

* * * * *